US009797025B2

(12) United States Patent
Peultier et al.

(10) Patent No.: US 9,797,025 B2
(45) Date of Patent: Oct. 24, 2017

(54) METHOD FOR MANUFACTURING AUSTENITE-FERRITE STAINLESS STEEL WITH IMPROVED MACHINABILITY

(71) Applicants: ArcelorMittal, Luxembourg (LU); Ugitech, Ugine (FR)

(72) Inventors: Jerome Peultier, Autun (FR); Amelie Fanica, Cersot (FR); Nicolas Renaudot, Albertville (FR); Christophe Bourgin, Alberville (FR); Eric Chauveau, Alberville (FR); Marc Mantel, Mercury (FR)

(73) Assignees: ArcelorMittal, Luxembourg (LU); Ugitech, Ugine (FR)

( * ) Notice: Subject to any disclaimer, the term of this patent is extended or adjusted under 35 U.S.C. 154(b) by 0 days.

(21) Appl. No.: 15/409,348

(22) Filed: Jan. 18, 2017

(65) Prior Publication Data

US 2017/0121789 A1 May 4, 2017

Related U.S. Application Data

(62) Division of application No. 13/808,284, filed as application No. PCT/FR2011/000394 on Jul. 5, 2011, now Pat. No. 9,587,286.

(30) Foreign Application Priority Data

Jul. 7, 2010 (WO) ..... PCT/FR2010/000498

(51) Int. Cl.

| | |
|---|---|
| ***C21D 8/00*** | (2006.01) |
| ***C21D 9/52*** | (2006.01) |
| ***B22D 11/00*** | (2006.01) |
| ***C21D 1/613*** | (2006.01) |
| ***C21D 1/60*** | (2006.01) |
| ***C21D 9/46*** | (2006.01) |
| ***C21D 8/02*** | (2006.01) |
| ***C21D 8/06*** | (2006.01) |
| ***C22C 38/60*** | (2006.01) |
| ***C22C 38/58*** | (2006.01) |
| ***C22C 38/54*** | (2006.01) |
| ***C22C 38/52*** | (2006.01) |
| ***C22C 38/50*** | (2006.01) |
| ***C22C 38/48*** | (2006.01) |
| ***C22C 38/46*** | (2006.01) |
| ***C22C 38/44*** | (2006.01) |
| ***C22C 38/42*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***B21B 3/02*** | (2006.01) |
| ***B21C 1/00*** | (2006.01) |
| ***B21J 1/02*** | (2006.01) |

(52) U.S. Cl.

CPC ..... *C21D 9/525* (2013.01); *B21B 3/02* (2013.01); *B21C 1/003* (2013.01); *B21J 1/02* (2013.01); *B22D 11/002* (2013.01); *C21D 1/60* (2013.01); *C21D 1/613* (2013.01); *C21D 8/0226* (2013.01); *C21D 8/0263* (2013.01); *C21D 8/065* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C22C 38/60* (2013.01); *C21D 2211/001* (2013.01); *C21D 2211/005* (2013.01)

(58) Field of Classification Search

CPC ..... C21D 6/004; C21D 8/0263; C21D 8/065; C21D 9/46; B21B 1/00; C22C 38/001

See application file for complete search history.

(56) References Cited

U.S. PATENT DOCUMENTS

| | | | |
|---|---|---|---|
| 5,672,215 | A | 9/1997 | Azuma et al. |
| 2009/0098007 | A1 | 4/2009 | Tsuge et al. |
| 2010/0000636 | A1 | 1/2010 | Bonnefois et al. |
| 2011/0097234 | A1 | 4/2011 | Oikawa et al. |

FOREIGN PATENT DOCUMENTS

| | | |
|---|---|---|
| EP | 0750053 | 12/1996 |
| EP | 2050832 | 4/2009 |
| EP | 2258885 | 12/2010 |
| FR | 2700174 | 7/1994 |
| WO | 2008088282 A1 | 7/2008 |

OTHER PUBLICATIONS

International Search Report Issued Sep. 26, 2011 in PCT/FR11/00394 Filed Jul. 5, 2011.

*Primary Examiner* — Alexander Polyansky

(74) *Attorney, Agent, or Firm* — Davidson, Davidson & Kappel, LLC; Jennifer L. O'Connell; William C. Gehris

(57) ABSTRACT

A method for manufacturing a plate, a band, or a coil of hot-rolled steel is provided. The method includes providing an ingot or a slab of steel with a desired composition and a microstructure composed of austenite and 35 to 65% ferrite by volume and hot rolling the ingot or slab at a temperature between 1150 and 1280° C. to obtain a plate, a band or a coil. A method for manufacturing a hot-rolled bar or wire of steel, a steel profile and a forged steel piece are also provided.

8 Claims, No Drawings

METHOD FOR MANUFACTURING AUSTENITE-FERRITE STAINLESS STEEL WITH IMPROVED MACHINABILITY

CROSS REFERENCE TO RELATED APPLICATIONS

This is a divisional of U.S. application Ser. No. 13/808,284 filed on Mar. 22, 2013 which is a national stage of PCT/FR2011/000394 filed Jul. 5, 2011 which claims priority to PCT/FR2010/000498 filed Jul. 7, 2010, the entire disclosures of which are hereby incorporated by reference herein.

The present invention concerns an austenite-ferrite stainless steel, more particularly one intended for the manufacture of structural elements for materials production (chemistry, petrochemistry, paper, offshore) or energy production facilities, without necessarily being limited to these.

BACKGROUND

This steel can more generally be used to replace a stainless steel of type 4301 in many applications, such as in the preceding industries or in the food and agriculture industry, including parts made from shaped wires (welded grids, etc.), profiles (strainers, etc.), axles, etc. One could also make molded parts and forged parts.

For this purpose, one is familiar with stainless steel grades of type 1.4301 and 1.4307, whose microstructure in the annealed state is essentially austenitic; in the cold-worked state, they can furthermore contain a variable proportion of work-hardened martensite. However, these steels contain large additions of nickel, whose cost is generally prohibitive. Furthermore, these grades can present problems from a technical standpoint for certain applications, since they have weak tensile characteristics in the annealed state, especially as regards the yield strength, and a not very high resistance to stress corrosion. Finally, these austenitic grades have elevated coefficients of thermal conductivity, which means that when they are used as reinforcement for concrete structures they prevent a good thermal insulation.

More recently, low-alloy austenite-ferrite grades have appeared, designated 1.4162, which contain low contents of nickel (less than 3%), no molybdenum, but high contents of nitrogen to make up for the low nickel level of these grades while preserving the desired austenite content. In order to be able to add nitrogen contents possibly greater than 0.200%, it is then necessary to add high contents of manganese. At such nitrogen levels, however, one observes the formation of longitudinal depressions in the continuous casting blooms which, in turn, cause surface defects on the rolled bars, which can be troublesome in certain cases. The manufacture of such grades is thus made particularly tricky due to this poor castability. Moreover, these grades have poor machinability.

Stainless steel grades called ferritic or ferrite-martensitic are also known whose microstructure is, for a defined range of heat treatments, composed of ferrite and martensite, such as the grade 1.4017 of standard EN10088. These grades, with chromium content generally below 20%, have elevated mechanical tensile characteristics, but do not have a satisfactory corrosion resistance.

BRIEF SUMMARY OF THE INVENTION

An object of the present invention is to remedy the drawbacks of the steels and manufacturing methods of the prior art by making available a stainless steel having, without excessive addition of costly alloy elements such as nickel and molybdenum:

- a good castability,
- good mechanical characteristics and in particular a yield strength limit greater than 400 or even 450 MPa in the annealed state or placed in solution and a good impact strength on plates and bars of great thickness, preferably greater than 100 J at 20° C. and greater than 20 J at −46° C.,
- an elevated generalized corrosion resistance, and
- a good machinability.

The present invention provides an austenite-ferrite stainless steel whose composition includes, in % by weight:

$0.01\% \le C \le 0.10\%$
$20.0\% \le Cr \le 24.0\%$
$1.0\% \le Ni \le 3.0\%$
$0.12\% \le N \le 0.20\%$
$0.5\% \le Mn \le 2.0\%$
$1.6\% \le Cu \le 3.0\%$
$0.05\% \le Mo \le 1.0\%$
$W \le 0.15\%$
$0.05\% \le Mo+W/2 \le 1.0\%$
$0.2\% \le Si \le 1.5\%$
$Al \le 0.05\%$
$V \le 0.5\%$
$Nb \le 0.5\%$
$Ti \le 0.5\%$
$B \le 0.003\%$
$Co \le 0.5\%$
$REM \le 0.1\%$
$Ca \le 0.03\%$
$Mg \le 0.1\%$
$Se \le 0.005\%$
$O \le 0.01\%$
$S \le 0.030\%$
$P \le 0.040\%$ the rest being iron and impurities resulting from the production and the microstructure being composed of austenite and 35 to 65% ferrite by volume, the composition furthermore obeying the following relations:

$$40 \le IF \le 65$$

with IF=10% Cr+5.1% Mo+1.4% Mn+24.3% Si+35% Nb+71.5% Ti−595.4% C−245.1% N−9.3% Ni−3.3% Cu−99.8 and $$IRCGCU \ge 32.0$$

with IRCGCU=% Cr+3.3% Mo+2% Cu+16% N+2.6% Ni−0.7% Mn and $$0 \le IU \le 6.0$$

with IU=3% Ni+% Cu+% Mn−100% C−25% N−2(% Cr+% Si)−6% Mo+45.

In preferred embodiments, taken alone or in combination, the steel according to the invention has:

- nitrogen content between 0.12 and 0.18% by weight,
- a copper content between 2.0 and 2.8% by weight,
- a molybdenum content less than 0.5% by weight,
- a carbon content less than 0.05% by weight.

A second object of the invention includes a method of manufacture of a plate, a band, or a hot-rolled coil of steel according to the invention whereby:

- one provides an ingot or a slab of a steel with a composition according to the invention, one hot rolls said ingot or said slab at a temperature between 1150 and 1280° C. to obtain a plate, a band, or a coil.

In one particular embodiment, the method of manufacture of a hot-rolled plate of steel according to the invention involves the steps of:

hot rolling said ingot or said slab at a temperature between 1150 and 1280° C. to obtain a so-called quarto plate, then performing a heat treatment at a temperature between 900 and 1100° C., and cooling said plate by quenching in air.

In another particular embodiment, the method of manufacture of a hot-rolled bar or wire of steel according to the invention includes the steps comprising:

providing a continuously cast ingot or slab of a steel with a composition according to the invention, hot rolling said ingot or said slab from a temperature between 1150 and 1280° C. to obtain a bar which is cooled in air or a wire coil that is cooled in water, then optionally performing a heat treatment at a temperature between 900 and 1100° C., and cooling said bar or said coil by quenching.

In particular embodiments, the method according to the invention furthermore includes the following characteristics, taken alone or in combination:

one performs a cold drawing of said bar or a wire drawing of said wire, at the end of the cooling, one performs a cold profiling of a hot-rolled bar obtained according to the invention, one cuts a hot-rolled bar obtained according to the invention into billets, then performs a forging of said billet between 1100° C. and 1280° C.

Other characteristics and advantages of the invention will appear upon reading the following description, given solely as an example.

DETAILED DESCRIPTION

The duplex stainless steel according to the invention contains the contents defined below.

The carbon content of the grade is between 0.01% and 0.10%, and preferably below 0.05% by weight. In fact, too high a content of this element reduces the localized corrosion resistance by increasing the risk of precipitation of chromium carbides in the heat-affected zones of welds.

The chromium content of the grade is between 20.0 and 24.0% by weight, and preferably between 21.5 and 24% by weight, in order to obtain a good corrosion resistance, which is at least equivalent to that obtained with grades of type 304 or 304L.

The nickel content of the grade is between 1.0 and 3.0% by weight, and is preferably less than or equal to 2.8% by weight. This austenite-forming element is added to obtain good properties of resistance to the formation of corrosion cavities. Adding this also helps achieve a good compromise between impact strength and ductility. In fact, it is of interest to shift the impact strength transition curve toward low temperatures, which is particularly advantageous for the manufacture of large bars or thick quarto plates for which the impact strength properties are important. One limits the content to 3.0% because of its elevated price.

Since the nickel content is limited in the steel according to the invention, it has been found to be advisable, in order to obtain an appropriate austenite content after heat treatment between 900° C. and 1100° C., to add other austenite-forming elements in unusually elevated quantities and to limit the contents of ferrite-forming elements.

Thus, the nitrogen content of the grade is between 0.12% and 0.20%, and preferably between 0.12% and 0.18%, which generally means that the nitrogen is added in the steel during the production process. This austenite-forming element first of all participates in producing a two-phase ferrite/austenite steel containing a proportion of austenite suitable for a good corrosion resistance under stress, but also in obtaining elevated mechanical characteristics. It also makes it possible to limit the formation of ferrite in the heat-affected zone of welded zones, which avoids the risks of embrittlement of these zones. One limits its maximum content because, above 0.16% of nitrogen, defects begin to appear in the continuously cast blooms. These defects consist of longitudinal depressions which in turn generate surface defects on the rolled bars, which can be troublesome in certain cases. Beyond 0.18%, the longitudinal depressions are very marked and one further observes blowholes connected with exceeding the maximum quantity of nitrogen which is able to remain in solution in the structure of this grade.

The manganese content of the grade is between 0.5% and 2.0% by weight, preferably between 0.5 and 1.9% by weight and even more preferred between 0.5 and 1.8% by weight. This is an austenite-forming element, but only below 1150° C. At higher temperatures, it retards the formation of austenite upon cooling, bringing about an excessive formation of ferrite in the heat-affected zones of welds, rendering them too low in impact strength. Furthermore, manganese if present in a quantity above 2.0% in the grade causes problems during the production and refining of the grade, since it attacks certain refractories used for the ladles, requiring a more frequent replacement of these costly elements and thus more frequent interruptions in the process. The additions of ferromanganese normally used to bring the grade up to the composition moreover contain notable contents of phosphorus, and also of selenium, which are not desirable for introduction in the steel and which are hard to remove during the refining of the grade. Furthermore, manganese disturbs this refining by limiting the possibility of decarburization. It also causes problems further downstream in the process, since it reduces the corrosion resistance of the grade by reason of the formation of manganese sulfides MnS, and oxidized inclusions. One preferably limits it to less than 1.9, even less than 1.8% by weight and even more preferably to less than 1.6% by weight, since tests have shown that the forgeability and more generally the hot transformation ability was improved when its content is decreased. In particular, one observes the formation of cracks, making the grade unsuitable for hot rolling, when the content is higher than 2.0%.

Copper, an austenite-forming element, is present in a content between 1.6 and 3.0% by weight, and preferably between 2.0 and 2.8% by weight, or even between 2.2 and 2.8% by weight. It participates in the obtaining of the desired two-phase austenite-ferrite structure, making it possible to obtain a better generalized corrosion resistance without being forced to increase the nitrogen level of the grade too much. Furthermore, copper in solid solution improves the corrosion resistance in a reducing acid environment. Below 1.6%, the nitrogen level needed to have the desired two-phase structure starts to become too large to prevent the surface quality problems of continuously cast blooms, as mentioned above. Above 3.0%, one begins to risk copper segregations and/or precipitations that can cause decreases in the localized corrosion resistance and decreases in impact strength during prolonged use (more than one year) above 200° C.

Molybdenum, a ferrite-forming element, is an element that is present in the grade in a content between 0.05 and 1.0%, or even between 0.05 and 0.5% by weight, whereas tungsten is an optional element that can be added in a content less than 0.15% by weight. However, it is preferable not to add tungsten, for cost reasons, which then limits its content to a residual 0.05% by weight.

Furthermore, the contents of these two elements are such that the sum Mo+W/2 is less than 1.0% by weight, preferably less than 0.5%, or even less than 0.4% by weight and especially preferably less than 0.3% by weight. In fact, the present inventors have found that by maintaining these two elements, as well as their sums, below the indicated values, one does not observe any embrittling intermetallic precipitations, which lets one in particular de-constrain the manufacturing process for steel plates or bands by allowing for a cooling of the plates and bands in air after heat treatment or working in the hot state. Furthermore, they have observed that, by controlling these elements in the limits claimed, one improves the weldability of the grade.

Silicon, a ferrite-forming element, is present in a content between 0.2% and 1.5% by weight, preferably less than 1.0% by weight. It is added to ensure a good deoxidation of the steel bath during the production process, but its content is limited by reason of the risk of sigma phase formation in event of a poor-quality quench after hot rolling.

Aluminum, a ferrite-forming element, is an optional element that can be added to the grade in a content less than 0.05% by weight and preferably between 0.005% and 0.040% by weight in order to obtain calcium aluminate inclusions with low melting point. One limits its maximum content in order to prevent an excessive formation of aluminum nitrides.

Vanadium, a ferrite-forming element, is an optional element that can be present in the grade in a quantity ranging from 0.02% to 0.5% by weight and preferably less than 0.2% by weight, so as to improve the pit corrosion resistance of the steel. It can also be present as a residual element contributed during the adding of chromium.

Niobium, a ferrite-forming element, is an optional element that can be present in the grade in a quantity ranging from 0.001% to 0.5% by weight. It allows one to improve the tensile strength of the grade and its machinability through a better chip breakage, thanks to the formation of fine niobium nitrides of type NbN or niobium and chromium nitrides of type NbCrN (Z phase). One limits its content to limit the formation of coarse niobium nitrides.

Titanium, a ferrite-forming element, is an optional element that can be present in the grade in a quantity ranging from 0.001% to 0.5% by weight and preferably in a quantity ranging from 0.001 to 0.3% by weight. It lets one improve the mechanical strength of the grade and its machinability by a better chip breakage, thanks to the formation of fine titanium nitrides. One limits its content in order to avoid the formation of clusters of titanium nitrides formed especially in the molten steel.

Boron is an optional element that can be present in the grade according to the invention in a quantity ranging from 0.0001% to 0.003% by weight, in order to improve its hot transformation.

Cobalt, an austenite-forming element, is an optional element that can be present in the grade in a quantity ranging from 0.02 to 0.5% by weight. This is a residual element brought in by the raw materials. One limits it chiefly because of maintenance problems which it can cause after irradiation of the pieces in nuclear installations.

The rare earth elements (referred to as REM) are optional elements that can be present in the grade in a quantity of 0.1% by weight. One will mention cerium and lanthanum in particular. One limits the contents in these elements because they are liable to form unwanted intermetallides.

One may also find calcium in the grade according to the invention, in a quantity ranging from 0.0001 to 0.03% by weight, and preferably over 0.0005% by weight, in order to control the nature of the oxide inclusions and improve the machinability. One limits the content of this element, since it is liable to combine with sulfur to form calcium sulfides which degrade the corrosion resistance properties.

An addition of magnesium in the amount of a final content of 0.1% can be done to modify the nature of the sulfides and oxides.

Selenium is preferably maintained at less than 0.005% by weight due to its harmful effect on the corrosion resistance. This element is generally brought into the grade as an impurity of ferromanganese ingots.

The oxygen content is preferably limited to 0.01% by weight, in order to improve the forgeability and the impact strength of welds.

Sulfur is maintained at a content below 0.030% by weight and preferably at a content below 0.003% by weight. As seen above, this element forms sulfides with manganese or calcium, the presence of which is harmful to the corrosion resistance. It is considered to be an impurity.

Phosphorus is maintained at a content below 0.040% by weight and is considered to be an impurity.

The rest of the composition is made up of iron and impurities. Besides those already mentioned above, one will mention in particular zirconium, tin, arsenic, lead or bismuth. Tin can be present in a content below 0.100% by weight and preferably below 0.030% by weight to prevent welding problems. Arsenic can be present in a content below 0.030% by weight and preferably below 0.020% by weight. Lead can be present in a content below 0.002% by weight and preferably below 0.0010% by weight. Bismuth can be present in a content below 0.0002% by weight and preferably below 0.00005% by weight. Zirconium can be present in the amount of 0.02%.

The microstructure of the steel according to the invention, in the annealed state, is composed of austenite and ferrite, which are preferably, after treatment of 1 h at 1050° C., in a proportion of 35 to 65% by volume of ferrite and more particularly preferred 45 to 55% by volume of ferrite.

The present inventors have also found that the following formula appropriately takes account of the content of ferrite at 1050° C.:

$$IF=10\%\ Cr+5.1\%\ Mo+1.4\%\ Mn+24.3\%\ Si+35\%\ Nb+71.5\%\ Ti-595.4\%\ C-245.1\%\ N-9.3\%\ Ni-3.3\%-Cu-99.8$$

Thus, to obtain a proportion of ferrite between 35 and 65% at 1050° C., the index IF should be between 40 and 65.

In the annealed state, the microstructure contains no other phases that would be harmful to its mechanical properties, such as the sigma phase and other intermetallide phases. In the cold-worked state, a portion of the austenite may have been converted into martensite, depending on the effective temperature of deformation and the amount of cold deformation applied.

Furthermore, the present inventors have found that, when the percentages by weight of chromium, molybdenum, copper, nitrogen, nickel and manganese obey the following relation, the grades in question have a good generalized corrosion resistance: [0089] IRCGU 32.0.gtoreq.and preferably.gtoreq.34.0 with IRCGU=% Cr+3.3% Mo+2% Cu+16% N+2.6% Ni−0.7% Mn Finally, the present inventors have ascertained that, when the percentages by weight of nickel, copper, manganese, carbon, nitrogen, chromium, silicon and molybdenum obey the following relation, the grades in question have a good machinability: [0091] 0.Itoreq.IU.Itoreq.6.0 with IU=3% Ni+% Cu+% Mn−100% C−25% N−2(% Cr+% Si)−6% Mo+45.

Generally speaking, the steel according to the invention can be produced and manufactured in the form of hot-rolled plates, also known as quarto plates, but also in the form of hot-rolled bands, from slabs or ingots, and also in the form of cold-rolled bands from hot-rolled bands. It can also be hot-rolled into bars or wire rods or into profiles or forged pieces; these products can then be transformed hot by forging or cold into drawn bars or profiles or into drawn wires. The steel according to the invention can also be worked by molding, followed by heat treatment or not.

In order to obtain the best possible performance, one will preferably use the method according to the invention that comprises first procuring an ingot, a slab or a bloom of steel having a composition according to the invention.

This ingot, slab, or bloom is generally obtained by melting of the raw materials in an electric furnace, followed by a vacuum remelting of type AOD or VOD with decarburization. One can then pour the grade in the form of ingots, or in the form of slabs or blooms by continuous casting in a bottomless ingot mold. One could also consider pouring the grade directly in the form of thin slabs, in particular by continuous casting between counter-rotating rolls.

After procurement of the ingot or slab or bloom, one will optionally perform a reheating to reach a temperature between 1150 and 1280° C., but it is also possible to work directly on the slab as it arrives from continuous casting, with the casting heat.

In the case of manufacture of plates, one then hot-rolls the slab or the ingot to obtain a so-called quarto plate which generally has a thickness between 5 and 100 mm. The reduction rates generally used at this stage vary between 3 and 30%. This plate is then subjected to a heat treatment of putting back in solution the precipitates formed at this stage by reheating at a temperature between 900 and 1100° C., then cooled.

The method according to the invention calls for a cooling by quenching in air, which is easier to accomplish than the classical cooling used for this type of grade, which is a more rapid cooling, by means of water. However, it remains possible to carry out a cooling in water, if so desired.

This slow cooling, in air, is made possible in particular thanks to the limited contents of nickel and molybdenum of the composition according to the invention, which is not subject to the precipitation of intermetallic phases that are harmful to its usage properties. This cooling can, in particular, be carried out at speeds ranging from 0.1 to 2.7° C./s.

At the end of the hot rolling, the quarto plate can be flattened, cropped and pickled, if one wishes to deliver it in this state.

One can also roll this bare steel on a hot strip mill with thicknesses between 3 and 10 mm.

In the case of manufacture of long products from ingots or blooms, one can hot roll in one or more heats on a multicage rolling stand, in grooved rolls, at a temperature between 1150 and 1280° C., to obtain a bar or a rolled wire or wire rod coil. The cross section ratio between the starting bloom and the end product is preferably greater than 3, in order to ensure the internal soundness of the rolled product.

When one has made a bar, it is cooled at the end of the rolling by simple laying in air.

When one has made rolled wire, this can be cooled, by quenching in a coil in a water tank at the exit from the rolling mill or by quenching in water in turns spread out on a conveyor after they have passed on a conveyor through a solution furnace at temperature between 850° C. and 1100° C.

A further heat treatment, in the furnace between 900° C. and 1100° C., can be done optionally on these bars or coils already treated in the rolling heat, if one wishes to accomplish a recrystallization of the structure and slightly lower the tensile strength characteristics.

At the end of the cooling of these bars or these wire coils, one could carry out various hot or cold shaping treatments, depending on the end use of the product. Thus, one could carry out a cold drawing of the bars or a drawing of the wires, at the end of the cooling.

One could also cold-profile the hot-rolled bars, or manufacture pieces after having cut the bars into billets and forging them.

EXAMPLES

Various melts were produced and then transformed into bars of different diameters and characteristics.

Mechanical Properties

The tensile properties Rp.sub.0.2 and R.sub.m were determined by the standard NFEN 10002-1. The impact strength KV was determined at different temperatures according to the standard NF EN 10045.

Lathe Turning Tests

These are done on a 28 kW lathe RAMO RTN30 running at a maximum of 5800 rpm, outfitted with a Kistler force plate. All the tests were done dry. The reference tip used is the tip STELLRAM SP0819 CNMG120408E-4E, considered to be optimal for duplex stainless steels.

These tests make it possible to determine two characteristic values for the level of machinability of a grade: [0111] a turning speed VB.sub.15/0.15 expressed in m/min (the higher VB.sub.15/0.15, the better the machinability), [0112] a chip breakage zone ZFC (the larger ZFC, the better the machinability).

1. Determination of $VB_{15/0.15}$

The test consists in finding the turning speed that generates 0.15 mm of flank wear for 15 min of effective machining. The test is done in regular turning passes with a coated carbide tip. The set parameters are:

pass depth a.sub.p=1.5 mm feed f=0.25 mm/rev.

During these tests, the flank wear is measured by an optical system coupled to a camera, at a magnification of .times.32. This measurement is the surface of the worn zone as a ratio of the apparent length of this zone. In the case when a notching appears that is greater than 0.45 mm (3 times the value of VB) or a tip failure occurs before obtaining a flank wear of 0.15 mm, one considers that the value of $VB_{15/0.15}$ cannot be found; one will then determine the maximum speed for which there is neither flank wear of 0.45 mm nor tip failure in 15 min and indicate as the result that $VB_{15/0.15}$ is greater than this value.

In the context of the present invention, one considers that a value of $VB_{15/0.15}$ less than 220 m/min, measured under the conditions described above, is not in conformity with the invention.

2. Determination of ZFC

Before determining the value of ZFC, one needs to define the minimum cutting speed, $Vc_{min}$.

2.1) Evaluation of $Vc_{min}$

The determination of $Vc_{min}$ is done by a turning pass at increasing speed. One starts with a very low cutting speed Vc (40 m/min), and rises in regular fashion to a speed greater than $VB_{15/0.15}$ during the course of the pass. Recording of the forces Kc lets one trace a direct curve Kc=f(Vc).

The cutting conditions are:

pass depth $a_p$=1.5 mm feed f=0.25 mm/rev tool broken in by one turning pass under the conditions of $VB_{15/0.15}$.

The curve obtained is monotonic decreasing in the majority of cases. The value of $Vc_{min}$ is that corresponding to an inflection of the curve.

2.2) Evaluation de ZFC

At a speed equal to 120% of $Vc_{min}$, one performs tests of 6 seconds machining at constant speed, varying the cutting conditions. One thus sweeps a table of feeds (from 0.1 mm/rev to 0.4 mm/rev per step of 0.05 mm/rev) and pass depths (from 0.5 mm to 4 mm per step of 0.5 mm).

For each of the 56 combinations of f-$a_p$, one evaluates the chips obtained, comparing them to the chip forms predefined in the standard of "C.O.M. lathe turning" ISO 3685. The ZFC is the zone of the table bringing together the conditions in f and $a_p$ for which the chips are well broken, which is quantified by counting the number of satisfactory combinations.

In the context of the present invention, one considers that a value of ZFC less than 15, measured under the conditions described above, is not in conformity with the invention.

Corrosion Tests

The critical current of dissolution or activity was determined, given in μA/cm$^2$ in sulfuric acid medium at 2 moles/liter at 23° C. A random potential measurement is first done for 900 seconds; next, a potentiodynamic curve is plotted at a speed of 10 mV/min from −750 mV/ECS to +1V/ECS. On the polarization curve so obtained, the critical current corresponds to the maximum current of the peak revealed prior to the passivity region.

The following tables summarize the compositions tested and the results and characterizations for the obtained products.

TABLE 1

Chemical compositions of the tests

| | 1* | 2* | 3* | 4* | 5* | 6 | 7 | 8 | 9 | 10 | 11 | 12 |
|---|---|---|---|---|---|---|---|---|---|---|---|---|
| C | 0.022 | 0.024 | 0.026 | 0.041 | 0.025 | 0.028 | 0.026 | 0.027 | 0.055 | 0.025 | 0.019 | 0.011 |
| Cr | 21.487 | 21.661 | 22.195 | 22.533 | 22.212 | 23.363 | 23.2070 | 21.377 | 18.21 | 22.159 | 22.733 | 25.185 |
| Ni | 2.406 | 2.399 | 2.719 | 2.741 | 2.581 | 2.603 | 2.621 | 1.596 | 8.598 | 4.227 | 5.41 | 6.215 |
| Cu | 2.520 | 2.479 | 2.499 | 2.535 | 2.497 | 0.131 | 0.203 | 0.365 | 0.386 | 0.271 | 0.289 | 1.794 |
| N | 0.146 | 0.166 | 0.145 | 0.141 | 0.175 | 0.191 | 0.194 | 0.210 | 0.038 | 0.113 | 0.156 | 0.227 |
| Mn | 1 | 1.065 | 0.958 | 1.500 | 1.51 | 1.17 | 1.152 | 4.983 | 0.725 | 1.057 | 1.522 | 1.208 |
| Mo | 0.114 | 0.109 | 0.125 | 0.106 | 0.057 | 0.101 | 0.244 | 0.329 | 0.334 | 0.271 | 2.759 | 3.640 |
| W | 0.06 | — | — | — | — | 0.007 | 0.028 | — | — | 0.016 | — | — |
| Si | 0.537 | 0.500 | 0.519 | 0.53 | 0.528 | 0.524 | 0.591 | 0.489 | 0.353 | 0.392 | 0.420 | 0.387 |
| Al | 0.018 | 0.017 | 0.018 | 0.018 | 0.018 | 0.013 | 0.022 | 0.017 | 0.002 | 0.014 | 0.015 | 0.002 |
| V | 0.132 | 0.126 | 0.131 | 0.090 | 0.038 | 0.134 | 0.111 | 0.0974 | 0.088 | 0.115 | 0.116 | 0.041 |
| Nb | 0.019 | 0.117 | 0.027 | 0.018 | 0.006 | 0.002 | 0.019 | 0.01 | 0.019 | 0.0096 | 0.025 | 0.0074 |
| Ti | 0.002 | 0.002 | 0.002 | 0.002 | 0.058 | 0.002 | 0.002 | 0.002 | 0.002 | 0.002 | 0.002 | 0.0048 |
| B | 0.0009 | 0.0009 | 0.0009 | 0.0009 | 0.0005 | 0.0008 | 0.0006 | 0.0018 | — | 0.0011 | 0.0009 | — |
| Co | 0.064 | 0.052 | 0.057 | 0.069 | 0.031 | 0.056 | 0.061 | 0.031 | 0.148 | 0.059 | 0.087 | 0.0254 |
| Ca | 0.0018 | 0.0005 | 0.0021 | 0.0033 | 0.0004 | 0.0005 | 0.0026 | 0.002 | 0.0012 | 0.0005 | 0.0011 | 0.0002 |
| O | 0.0044 | 0.0052 | 0.0048 | 0.0051 | 0.0042 | 0.0053 | 0.0043 | 0.0029 | 0.0031 | 0.0053 | 0.005 | 0.0048 |
| S | 0.0005 | 0.0005 | 0.0007 | 0.0002 | 0.0003 | 0.0007 | 0.0002 | 0.0007 | 0.0189 | 0.0002 | 0.0006 | 0.0002 |
| P | 0.0225 | 0.0214 | 0.0194 | 0.0223 | 0.0221 | 0.0224 | 0.0248 | 0.0195 | 0.0266 | 0.0235 | 0.0266 | 0.0096 |
| Se | <0.002 | <0.002 | <0.002 | <0.002 | <0.002 | <0.002 | <0.002 | <0.002 | <0.002 | <0.002 | <0.002 | <0.002 |
| REM | <0.002 | <0.002 | <0.002 | <0.002 | <0.002 | <0.002 | <0.002 | <0.002 | <0.002 | <0.002 | <0.002 | <0.002 |
| Mg | 0.0006 | <.0005 | 0.0011 | 0.0010 | <.0005 | 0.0012 | 0.0006 | <.0005 | <.0005 | <.0005 | 0.0011 | 0.0009 |

*according to the invention

TABLE 2

Bars of 73 mm diameter

| | 1* | 2* | 3* | 4* | 5* | 6 | 7 | 8 | 9 | 10 | 11 | 12 |
|---|---|---|---|---|---|---|---|---|---|---|---|---|
| Rm (MPa) | 717 | 726 | 722 | 715 | 727 | 668 | 714 | 709 | 605 | 656 | 773 | 890 |
| $R_{p0.2}$ (MPa) | 571 | 508 | 566 | 584 | 568 | 493 | 554 | 479 | 323 | 482 | 578 | 732 |
| KV at 20° C. (J) | 311 | 125 | 356 | 107 | 134 | 51 | 51 | ne | ne | 382 | 358 | ne |
| KV at −46° C. (J) | 32 | 24 | 103 | 29 | 31 | 14 | 13 | ne | ne | 220 | 190 | ne |
| IF | 51.3 | 49.8 | 53.3 | 49.0 | 51.9 | 60.8 | 62.2 | 51.4 | −28.9 | 51.9 | 54.1 | 56.4 |
| % ferrite at 1050° C. | 50.7 | 48.6 | 50.0 | 49.0 | 51.4 | 61.2 | 63.1 | 49.9 | ne | ne | ne | ne |
| Longitudinal depressions | no | no | no | no | no | yes | yes | yes | no | no | no | yes |

TABLE 2-continued

| | Bars of 73 mm diameter | | | | | | | | | | | |
|---|---|---|---|---|---|---|---|---|---|---|---|---|
| | 1* | 2* | 3* | 4* | 5* | 6 | 7 | 8 | 9 | 10 | 11 | 12 |
| IU | 5.16 | 4.22 | 4.21 | 2.87 | 4.05 | −1.85 | −2.29 | 1.48 | 26.33 | 6.96 | −5.62 | −13.11 |
| $V_{b15/0.15}$ (m/min) | 240 | 240 | 240 | 220 | 230 | 210 | 210 | 220 | 220 | 240 | 200 | 140 |
| ZFC | 22 | 27 | 19 | 21 | 27 | ne | 26 | 24 | ne | 12 | 15 | 19 |

*according to the invention
ne: not evaluated

TABLE 3

| | Bars of 5.5 mm diameter | | | | | | | | | | | |
|---|---|---|---|---|---|---|---|---|---|---|---|---|
| | 1* | 2* | 3* | 4* | 5* | 6 | 7 | 8 | 9 | 10 | 11 | 12 |
| IRCGU | 34.8 | 35.1 | 36.3 | 36.3 | 35.8 | 33.0 | 33.5 | 27.2 | 42.6 | 35.7 | 47.9 | 59.7 |
| I critique $H_2SO_4$•2M | 45 | ne | 33 | ne | 40 | 33 | 34 | 79 | 22 | 15 | <5 | <5 |

*according to the invention

One finds, first of all, that the comparison grades 6 to 8 and 12 show a formation of longitudinal depressions on the continuous casting blooms, whereas the grades 1 to 5 according to the invention were free of these, thus showing the good castability of the grade according to the invention.

Furthermore, the yield strength limit of the tests according to the invention is quite higher than 450 MPa, unlike what is observed for comparison grade 9, for example.

The impact strength values on plates and bars of great thickness at 20° C., as at −46° C., are likewise satisfactory and in particular better than that of the comparison grades 6 and 7, for example.

The grades according to the invention furthermore all present a good machinability, both in terms of cutting speed and chip breakage zone. On the contrary, one finds that the comparison grades 6 and 7, as well as 11 and 12, whose IU indices are negative, do not present a satisfactory cutting speed, while comparison grade 10, whose IU index is greater than 6.0, has an insufficient chip breakage zone.

The generalized corrosion resistance of the grades according to the invention is very satisfactory, and in particular better than that of comparison grade 8.

One thus finds that the grades according to the invention are the only ones to bring together all of the properties sought, namely, a good castability, a yield strength limit greater than 400 or even 450 MPa in the annealed state or in solution, a good impact strength on plates and bars of great thickness, preferably higher than 100 J at 20° C. and higher than 20 J at −46° C., an elevated generalized corrosion resistance, and a good machinability.

What is claimed is:

1. A method for manufacturing a plate, a band, or a coil of hot-rolled steel comprising the steps of:

providing an ingot or a slab of steel with a composition comprising in % by weight:

0.01%≤C≤0.10%
20.0%≤Cr≤24.0%
1.0%≤Ni≤3.0%
0.12%≤N≤0.20%
0.5%≤Mn≤2.0%
1.6%≤Cu≤3.0%
0.05%≤Mo≤1.0%
W≤0.15%
0.05%≤Mo+W/2≤1.0%
0.2%≤Si≤1.5%
Al≤0.05%
V≤0.5%
Nb≤0.5%
Ti≤0.5%
B≤0.003%
Co≤0.5%
REM≤0.1%
Ca≤0.03%
Mg≤0.1%
Se≤0.005%
O≤0.01%
S≤0.030%
P≤0.040% the rest being iron and impurities resulting from the production and a microstructure being composed of austenite and 35 to 65% ferrite by volume, the composition furthermore obeying the following relations:

$$40 \leq IF \leq 65$$

with IF=10% Cr+5.1% Mo+1.4% Mn+24.3% Si+35% Nb+71.5% Ti−595.4% C−245.1% N−9.3% Ni−3.3% Cu−99.8; and $$IRCGCU \geq 32.0$$

with IRCGCU=% Cr+3.3% Mo+2% Cu+16% N+2.6% Ni−0.7% Mn; and $$0 \leq IU \leq 6.0$$

with IU=3% Ni+% Cu+% Mn−100% C−25% N−2(% Cr+% Si)−6% Mo+45; and hot rolling the ingot or slab at a temperature between 1150 and 1280° C. to obtain the plate, the band or the coil.

2. The method as recited in claim 1, wherein the plate obtained after hot rolling is a quarto plate and further comprising the steps of:

heat treating the quarto plate at a temperature between 900 and 1100° C.; and cooling the quarto plate by quenching in air.

3. A method for manufacturing a hot-rolled bar or wire of steel comprising the steps of:

providing a continuously cast ingot or bloom of steel with a composition comprising in % by weight:

0.01%≤C≤0.10%
20.0%≤Cr≤24.0%

1.0%≤Ni≤3.0%
0.12%≤N≤0.20%
0.5%≤Mn≤2.0%
1.6%≤Cu≤3.0%
0.05%≤Mo≤1.0%
W≤0.15%
0.05%≤Mo+W/2≤1.0%
0.2%≤Si≤1.5%
Al≤0.05%
V≤0.5%
Nb≤0.5%
Ti≤0.5%
B≤0.003%
Co≤0.5%
REM≤0.1%
Ca≤0.03%
Mg≤0.1%
Se≤0.005%
O≤0.01%
S≤0.030%
P≤0.040% the rest being iron and impurities resulting from the production and a microstructure being composed of austenite and 35 to 65% ferrite by volume, the composition furthermore obeying the following relations:

$$40 \leq IF \leq 65$$

with IF=10% Cr+5.1% Mo+1.4% Mn+24.3% Si+35% Nb+71.5% Ti−595.4% C−245.1% N−9.3% Ni−3.3% Cu−99.8; and $$IRCGCU \geq 32.0$$

with IRCGCU=% Cr+3.3% Mo+2% Cu+16% N+2.6% Ni−0.7% Mn; and $$0 \geq IU \geq 6.0$$

with IU=3% Ni+% Cu+% Mn−100% C−25% N−2(% Cr+% Si)−6% Mo+45;

hot rolling the continuously cast ingot or bloom at a temperature between 1150 and 1280° C. to obtain a bar or a wire coil; and cooling the bar in air or cooling the wire coil in water.

4. The method as recited in claim 3, further comprising the step of:

heating treating the bar or wire coil at a temperature between 900 and 1100° C.; and cooling the bar or wire coil by quenching.

5. The method as recited in claim 3, further comprising the step of:

cold drawing the bar or wire drawing the wire coil, at the end of the cooling.

6. The method as recited in claim 4, further comprising the step of:

cold drawing the bar or wire drawing the wire coil, at the end of the cooling.

7. A method for manufacturing a steel profile comprising the steps of:

providing the-hot rolled bar manufactured by the method recited in claim 3; and cold profiling the hot-rolled bar.

8. A method for manufacturing a forged steel piece comprising the steps of:

providing the-hot rolled bar manufactured by the method recited in claim 3;

cutting the hot-rolled bar into billets, and forging of said billet between 1100° C. and 1280° C.

* * * * *